US009780505B2

(12) United States Patent
Peng et al.

(10) Patent No.: US 9,780,505 B2
(45) Date of Patent: Oct. 3, 2017

(54) TYPE-C-BASED USB CONNECTOR CAPABLE OF TRANSMITTING LARGE CURRENT

(71) Applicant: ALL BEST ELECTRONICS TECHNOLOGY CO., LTD, Suzhou, Jiangsu (CN)

(72) Inventors: Yiping Peng, Jiangsu (CN); Chongyang Zhai, Jiangsu (CN); Anding Zhang, Jiangsu (CN); Zhengyun Cheng, Jiangsu (CN)

(73) Assignee: ALL BEST ELECTRONICS TECHNOLOGY CO., LTD, Suzhou (CN)

( * ) Notice: Subject to any disclaimer, the term of this patent is extended or adjusted under 35 U.S.C. 154(b) by 0 days.

(21) Appl. No.: 15/327,377

(22) PCT Filed: Nov. 24, 2015

(86) PCT No.: PCT/CN2015/095350

§ 371 (c)(1),
(2) Date: Jan. 18, 2017

(87) PCT Pub. No.: WO2016/192334

PCT Pub. Date: Dec. 8, 2016

(65) Prior Publication Data

US 2017/0201052 A1 Jul. 13, 2017

(30) Foreign Application Priority Data

Jun. 5, 2015 (CN) ..... 2015 1 0301780

(51) Int. Cl.
*H01R 13/648* (2006.01)
*H01R 24/60* (2011.01)
(Continued)

(52) U.S. Cl.
CPC ..... *H01R 24/60* (2013.01); *H01R 13/26* (2013.01); *H01R 13/6597* (2013.01); *H01R 2107/00* (2013.01)

(58) Field of Classification Search
CPC .... H01R 24/60; H01R 13/26; H01R 13/6597; H01R 2107/00; H01R 12/00
(Continued)

(56) References Cited

U.S. PATENT DOCUMENTS 7,972,151 B2 * 7/2011 He ..... H01R 13/6471 439/108
8,079,854 B2 * 12/2011 He ..... H01R 13/6467 439/108
(Continued)

FOREIGN PATENT DOCUMENTS

CN 204720620 U 10/2015

OTHER PUBLICATIONS

International search report of PCT Patent Application No. PCT/CN2015/095350 issued on Mar. 9, 2016.

*Primary Examiner* — Abdullah Riyami
*Assistant Examiner* — Nader Alhawamdeh

(57) ABSTRACT

The present invention provides a Type-C-based USB connector capable of transmitting large current. Since the lower ground terminal and the lower power signal terminal both are of tear structures, and the ground base of the lower ground terminal, the power signal base of the lower power signal terminal, the main body of the lower ground terminal and the main body of the lower power signal terminal are all widened parts, the active areas of the ground terminal and the power signal terminal are larger, which improves the ability and reliability to transmit large current, thus solving the technical problem that the temperature would be much too high when large current are transmitted. With the present
(Continued)

invention, it is possible to improve reliability and operation ease of the product for transmitting large current.

12 Claims, 5 Drawing Sheets

(51) Int. Cl.
*H01R 13/26* (2006.01)
*H01R 13/6597* (2011.01)
*H01R 107/00* (2006.01)

(58) Field of Classification Search
USPC ..... 439/660, 108, 607.34
See application file for complete search history.

(56) References Cited

U.S. PATENT DOCUMENTS 8,851,927 B2 * 10/2014 Hsu ..... H01R 12/724
439/607.11
9,647,369 B2 * 5/2017 Tsai ..... H01R 4/02

* cited by examiner

TYPE-C-BASED USB CONNECTOR CAPABLE OF TRANSMITTING LARGE CURRENT

FIELD OF THE INVENTION

The present invention relates to the technical field of electrical connector, in particular, Type-C-based USB connector capable of transmitting large current.

BACKGROUND OF THE INVENTION

With the rapid development of science and technology in electronic industry, electronic devices are becoming thinner and smaller. Thus, the components of the electronic devices need to be smaller, which brings great challenge to the field of connector. New Type-C USB connector is smaller in size and accommodate better to mechanical and electrical requirements. In order to ensure the reliability of the products for transmitting large current, manufactures develop their respective designs. However, because of the small dimension of the new Type-C USB connector and large number of the terminals, the space is limited and it is impossible to reduce the resistance of the terminals by configurations. Therefore, it is common practice to choose special copper alloy having higher conductivity as the material for the terminals. However, this type of copper alloy is costly, resulting in that the overall cost of the product remains high.

SUMMARY OF THE INVENTION

The technical problem to be solved by the present invention is to provide a Type-C-based USB connector, which is simple in structure, cheap to manufacture and suitable for mass production, and which more importantly can improve reliability and operation ease of the product for transmitting large current.

In order to achieve said technical effect, the present invention provides a Type-C-based USB connector capable of transmitting large current, comprising a housing, an upper insert member and a lower insert member, the upper insert member comprising an upper insulating body and an upper row of conductive terminal, the lower insert member comprising a lower insulating body and integrally formed metallic shielding layer and lower row of conductive terminal, wherein said upper row of conductive terminal comprises at least an upper ground terminal and an upper power signal terminal, and said lower row of conductive terminal comprises at least a lower ground terminal and a lower power signal terminal, wherein each conductive terminal comprises a joint portion at a front end, a soldering portion at a rear end, and a main body provided within the insulating body and positioned between the joint portion and the soldering portion;

the joint portion of the lower ground terminal comprises a ground base and a plate-shaped ground portion protruding downward from the ground base, the ground portion lies in a different plane from that of the ground base, the ground base is provided within the lower insulating body, and the ground portion emerges from the lower insulating body for contacting with the ground terminal of a joint connector;

the joint portion of the lower power signal terminal comprises a power signal base and a plate-shaped signal power portion protruding downward from the power signal base, the power signal portion lies in a different plane from that of the power signal base, the power signal base is provided within the lower insulating body, and the power signal portion emerges from the lower insulating body for contacting with the power signal terminal of a joint connector;

the ground base of the lower ground terminal, the power signal base of the lower power signal terminal, the main body of the lower ground terminal and the main body of the lower power signal terminal are all widened parts.

Preferably, the width of the widened parts is between 0.50 mm to 1.00 mm.

Preferably, the width of the widened parts is between 0.50 mm to 0.80 mm.

Preferably, the connecting position of the metallic shielding layer with the joint portion of the lower ground terminal corresponds to the position of the ground base, and the connecting position of the metallic shielding layer with the joint portion of the lower power signal terminal corresponds to the position of the power signal base.

Preferably, the ground base and the ground portion are formed integrally, the power signal base and the power signal portion are formed integrally.

Preferably, the joint portion of the lower ground terminal and the main body of the lower ground terminal are formed integrally, and the joint portion of the lower power signal terminal and the main body of the lower power signal terminal are formed integrally.

Preferably, the lower insulating body is provided with an opening corresponding to the ground portion of the lower ground terminal, so that the ground portion of the lower ground terminal emerges from the lower insulating body via this opening, so as to contact with the ground terminal of a joint connector.

Preferably, the lower insulating body is provided with an opening corresponding to the power signal portion of the lower power signal terminal, so that the power signal portion of the lower power signal terminal emerges from the lower insulating body via this opening, so as to contact with the power signal terminal of a joint connector.

Preferably, the soldering portion is a part that extends rearward and beyond the lower insulating body.

Preferably, the front end of the housing has a joint port that is oval shaped, for positive and negative insertions of a joint connector.

In the practice of the present invention, the following advantages are achieved.

The ground terminal and power signal terminal are both of tear structure, that is, the joint portion of the lower ground terminal comprises a ground base and a plate-shaped ground portion protruding downward from the ground base, and the ground portion lies in a different plane from that of the ground base; and the joint portion of the lower power signal terminal comprises a power signal base and a plate-shaped signal power portion protruding downward from the power signal base, and the power signal portion lies in a different plane from that of the power signal base.

Where the ground base is provided within the lower insulating body, and the ground portion emerges from the lower insulating body for contacting with the ground terminal of a joint connector, and the ground base and the ground portion are integrally formed; and the power signal base is provided within the lower insulating body, and the power signal portion emerges from the lower insulating body for contacting with the power signal terminal of a joint connector, and the power signal base and the power signal portion are integrally formed. Further, the ground base of the lower ground terminal, the power signal base of the lower power signal terminal, the main body of the lower ground terminal and the main body of the lower power signal terminal are all widened parts. Therefore, the active areas of the ground terminal and the power signal terminal are larger, which improves the ability and reliability to transmit large current, thus solving the technical problem that the temperature would be much too high when large current are transmitted. In addition, the connector of the present invention is simple in structure, cheap to manufacture and suitable for mass production.

Further, the width of said widened parts is preferably between 0.50 mm to 1.00 mm. If said width is less than 0.50 mm, it is difficult to transmit large current, and if said width is larger than 1.00 mm, there is an increasing risk that short circuit would occur.

DETAILED DESCRIPTION OF ILLUSTRATED EMBODIMENTS

For better understanding the objects, technical solutions and advantages of the present invention, the present invention is now described in detail in the following with reference to the drawings. It is to be noted that, the directional terms "upper", "lower", "left", "right", "front", "rear", "inner", "outer" and the like are illustrative only with respect to the drawings, and should not be interpreted as to limit the present invention.

Figure 1:
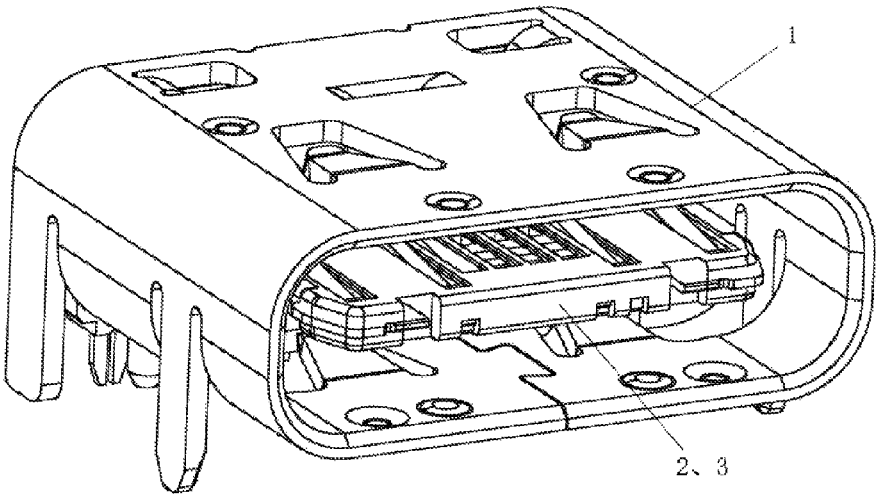
FIG. 1 is a perspective assembled view of the USB connector of the present invention.
Figure 2:
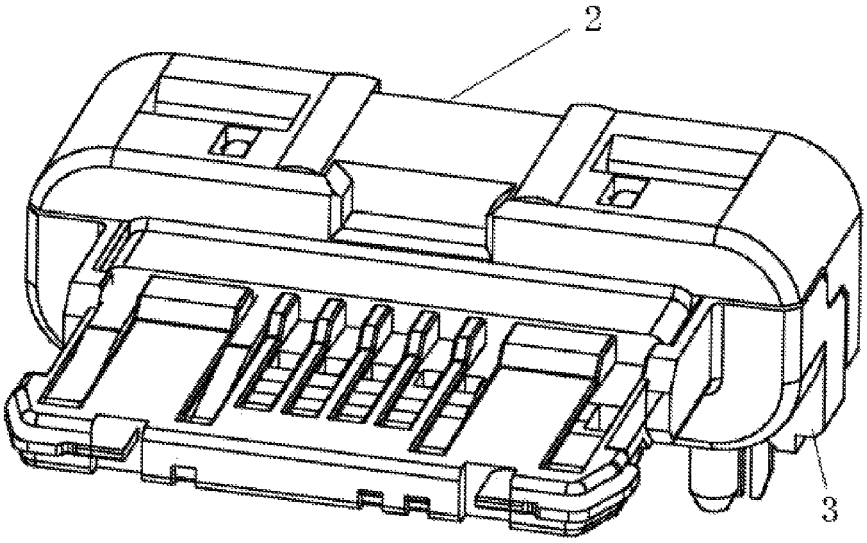
FIG. 2 is a perspective assembled view of the insert member of the USB connector shown in FIG. 1.
Figure 3:
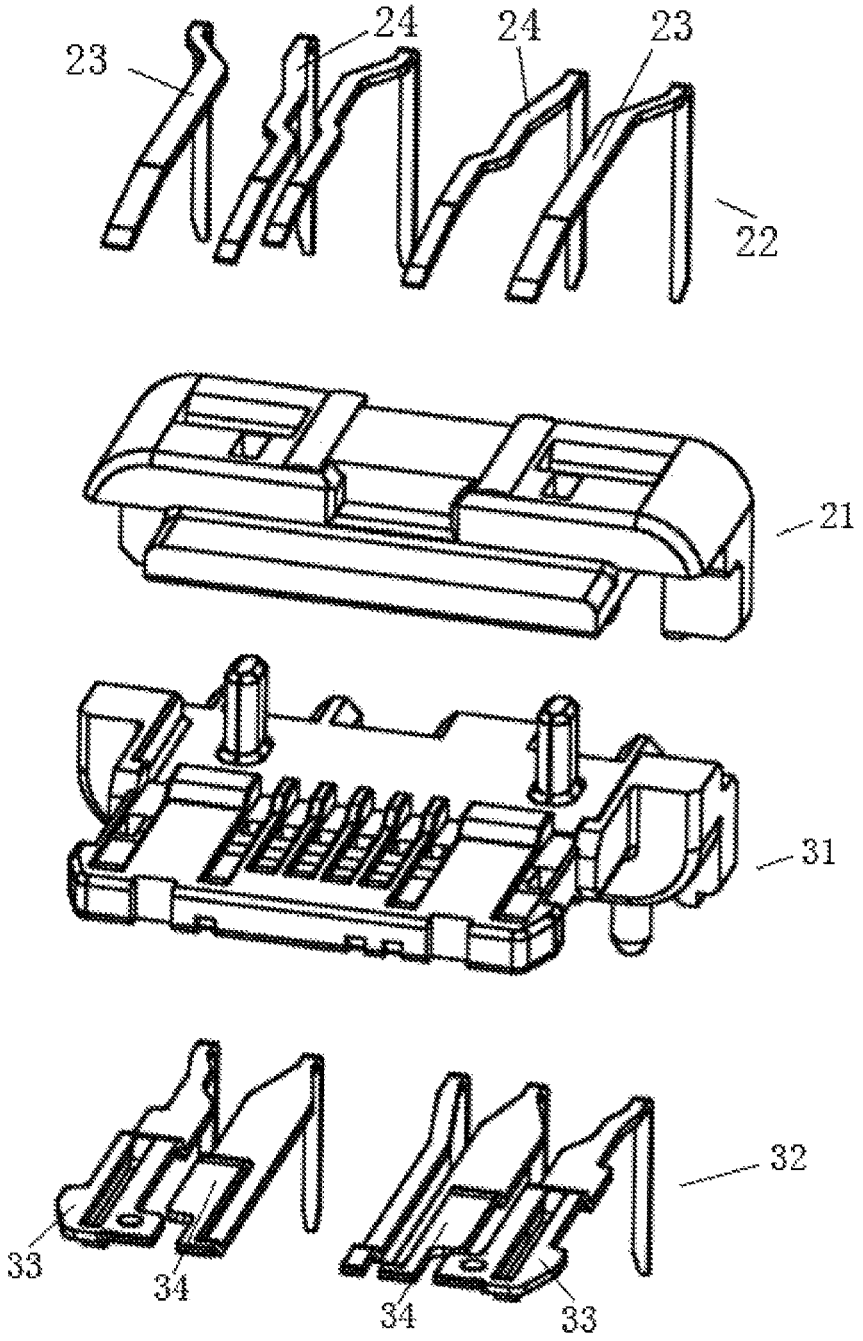
FIG. 3 is a perspective exploded view of the insert member shown in FIG. 2.

Referring to FIGS. 1-3, the present invention provides a Type-C-based USB connector capable of transmitting large current, comprising a housing 1, upper insert member 2 and lower insert member 3. The upper insert member 2 comprises an upper insulating body 21, an upper row of conductive terminals 22, and the lower insert member 3 comprises a lower insulating body 31, integrally formed metallic shielding layer and lower row of conductive terminals 32. The upper row of conductive terminals 22 comprises at least an upper ground terminal 23 and an upper power signal terminal 24, and the lower row of conductive terminals 32 comprises at least a lower ground terminal 33 and a lower power signal terminal 34, wherein each conductive terminal comprises a joint portion at the front end, a soldering portion at the rear end and a main body provided within the insulating body and positioned between the joint portion and the soldering portion.

Figure 4:
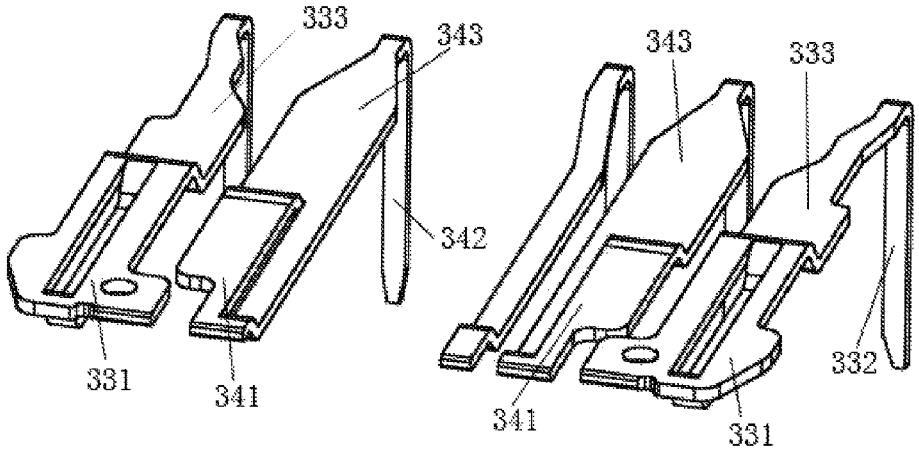
FIG. 4 is an illustration of integrally formed metallic shielding layer and lower row of conductive terminals shown in FIG. 3.

Referring specifically to FIG. 4, the lower ground terminal 33 comprises a joint portion 331 at the front end, a soldering portion 332 at the rear end and a main body 333 provided within the insulating body and positioned between the joint portion and the soldering portion, wherein the soldering portion 332 is a part of the lower ground terminal 33 that extends rearward and beyond the lower insulating body 31. The lower power signal terminal 34 comprises a joint portion 341 at the front end, a soldering portion 342 at the rear end and a main body 343 provided within the insulating body and positioned between the joint portion and the soldering portion, wherein the soldering portion 342 is a part of the lower ground terminal 34 that extends rearward and beyond the lower insulating body 31.

Figure 5:
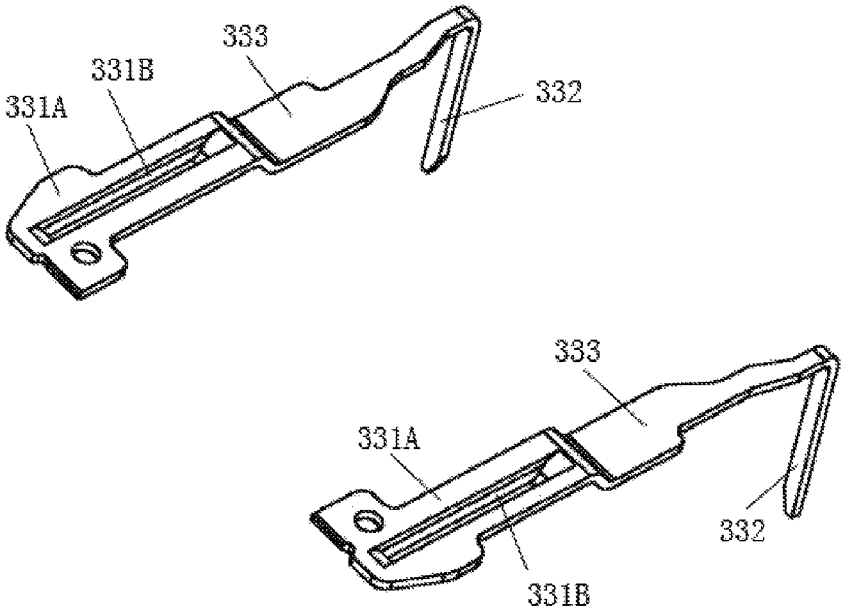
FIG. 5 is an illustration of the lower ground terminal shown in FIG. 4.
Figure 6:
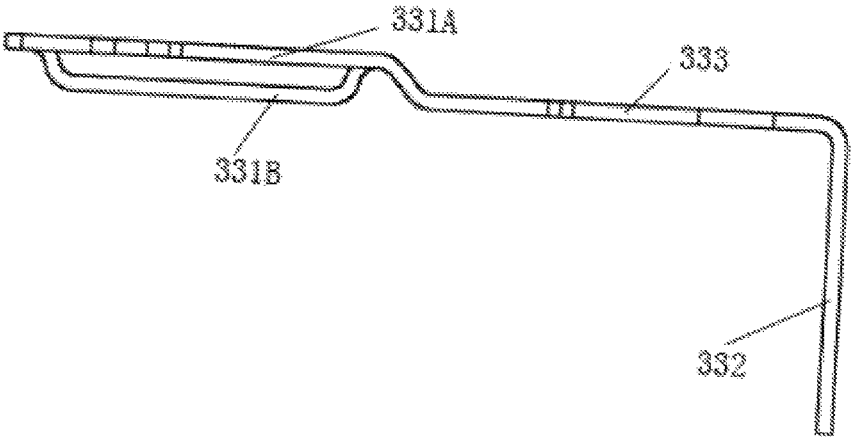
FIG. 6 is an illustration from another view of the lower ground terminal shown in FIG. 5.

Referring to FIGS. 5-6, the joint portion 331 of the lower ground terminal 33 comprises a ground base 331A and a plate-shaped ground portion 331B protruding downward from the ground base 331A. The ground portion 331B lies in a different plane from that of the ground base 331A, the ground base 331A is provided within the lower insulating body 31, and the ground portion 331B emerges from the lower insulating body 31 for contacting with the ground terminal of a joint connector. That is to say, the lower ground terminal 33 of the present invention has a tear structure.

Figure 7:
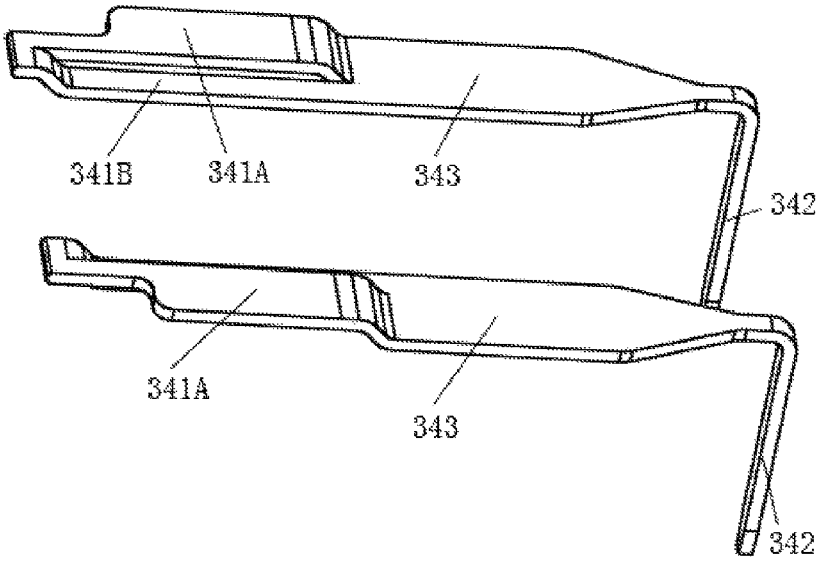
FIG. 7 is an illustration of the lower power signal terminal shown in FIG. 4.
Figure 8:
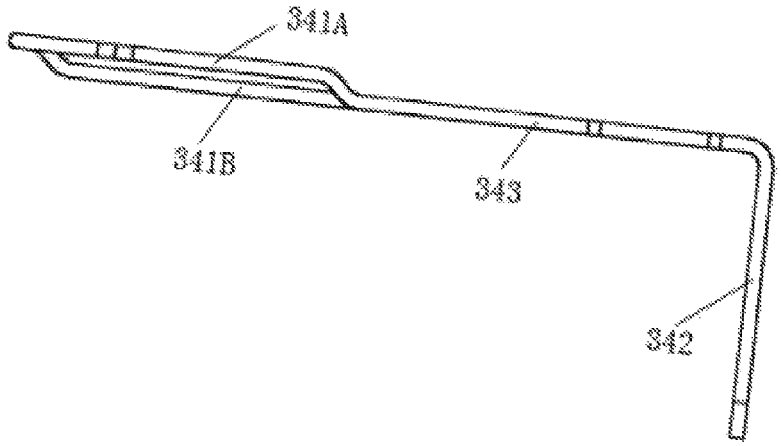
FIG. 8 is an illustration from another view of the lower power signal terminal shown in FIG. 7.

Referring to FIGS. 7-8, the joint portion 341 of the lower power signal terminal 34 comprises a power signal base 341A and a plate-shaped signal power portion 341B protruding downward from the power signal base 341A. The power signal portion 341B lies in a different plane from that of the power signal base 341A, the power signal base 341A is provided within the lower insulating body 31, and the power signal portion 341B emerges from the lower insulating body 31 for contacting with the power signal terminal of a joint connector. That is to say, the lower power signal terminal 34 of the present invention has a tear structure.

It is to be noted that, the metallic shielding layer and the lower row of conductive terminals 32 are formed integrally, wherein the connecting position of the metallic shielding layer with the joint portion 331 of the lower ground terminal 33 corresponds to the position of the ground base 331A, and the connecting position of the metallic shielding layer with the joint portion 341 of the lower power signal terminal 34 corresponds to the position of the power signal base 341A.

Figure 9:
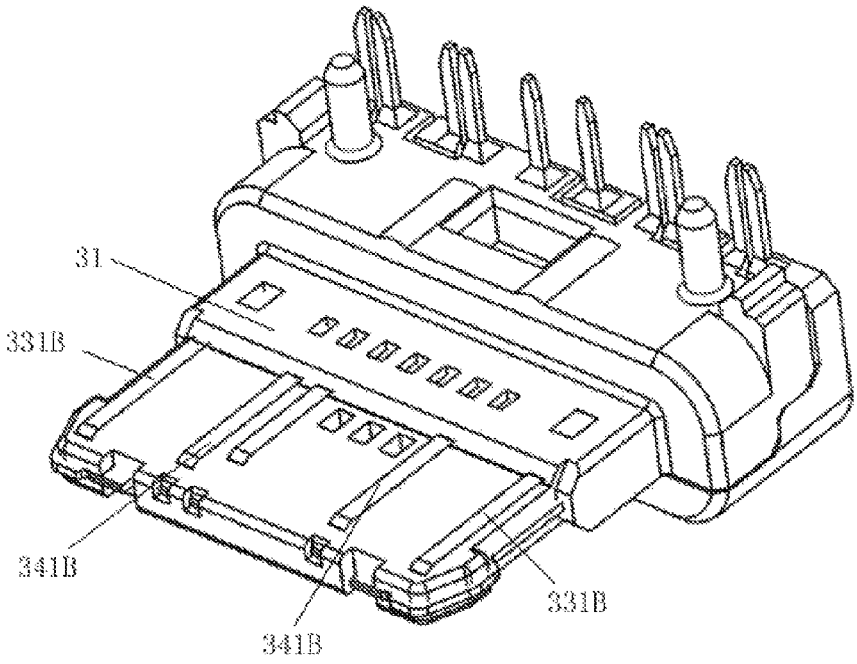
FIG. 9 is an illustration of integrally formed metallic shielding layer and lower row of conductive terminals shown in FIG. 4, which are formed on the lower insulating body.

Referring to FIG. 9, as a preferred embodiment of the ground portion 331B of the lower ground terminal 33 that emerges from the lower insulating body 31, the lower insulating body 31 is provided with an opening corresponding to the ground portion 331B of the lower ground terminal 33, so that the ground portion 331B of the lower ground terminal 33 emerges from the lower insulating body 31 via this opening, so as to contact with the ground terminal of a joint connector.

As a preferred embodiment of the power signal portion 341B of the lower power signal terminal 34 that emerges from the lower insulating body 31, the lower insulating body 31 is provided with an opening corresponding to the power signal portion 341B of the lower power signal terminal 34, so that the power signal portion 341B of the lower power signal terminal 34 emerges from the lower insulating body 31 via this opening, so as to contact with the power signal terminal of a joint connector.

As to the manufacturing of the ground portion 331B and the power signal portion 341B, it is known to one of ordinary skill in the art to form a tear structure via cutting during a stamping process of the metallic shielding layer. The stamping and cutting process is a mature process in the art, which is easy to carry out and capable for mass production. The ground portion 331B and the power signal portion 341B formed by stamping and cutting process are substantially plates in shape, which are simple in structure and easy to operate and which also facilitate mass production and reduction in production cost.

The ground base 331A of the lower ground terminal 33, the power signal base 341A of the lower power signal terminal 34, the main body 333 of the lower ground terminal 33 and the main body 343 of the lower power signal terminal 34 are all widened parts. The width of these widened parts is preferably between 0.50 mm to 1.00 mm. If said width is less than 0.50 mm, it is difficult to transmit large current, and if said width is larger than 1.00 mm, there is an increasing risk that short circuit would occur. More preferably, the width of said widened parts is between 0.50 mm to 0.80 mm.

Since the lower ground terminal and the lower power signal terminal both are of tear structures, and the ground base of the lower ground terminal, the power signal base of the lower power signal terminal, the main body of the lower ground terminal and the main body of the lower power signal terminal are all widened parts, the active areas of the ground terminal and the power signal terminal are larger, which improves the ability and reliability to transmit large current, thus solving the technical problem that the temperature would be much too high when large current are transmitted.

Further, the ground base 331A and the ground portion 331B are formed integrally, the power signal base 341A and the power signal portion 341B are formed integrally, the joint portion 331 of the lower ground terminal 33 and the main body 333 of the lower ground terminal 33 are formed integrally, and the joint portion 341 of the lower power signal terminal 34 and the main body 343 of the lower power signal terminal 34 are formed integrally, which simplifies the structures, reduces the dimensions and ensures the reliability and high efficiency of transmitting large current.

The front end of the housing 1 has a joint port that is oval shaped, for positive and negative insertions of a joint connector, which is advantageous and convenient regarding adaptation to both positive and negative insertions.

It is to be noted that, what are shown in FIGS. 1-9 are embodiments of the present invention which is applied to a USB connector. The USB connector shown in FIGS. 1-9 has 10 terminals, wherein the upper row of conductive terminal 22 comprises an upper ground terminal, an upper power signal terminal, an upper CC terminal, an upper D+ terminal and an upper D− terminal, and the lower row of conductive terminal 32 comprises a lower ground terminal, a lower power signal terminal, a lower CC terminal, a lower D+ terminal and a lower D− terminal.

The present invention applies to other types of USB connectors, for example but not limited to USB connector with 12 terminals, USB connector with 14 terminals, and USB connector with 16 terminals.

When the present invention is used with a USB connector with 12 terminals, the upper row of conductive terminal 22 comprises an upper ground terminal, an upper power signal terminal, an upper CC terminal, an upper power signal terminal and an upper ground terminal, and the lower row of conductive terminal 32 comprises a lower ground terminal, a lower power signal terminal, a lower CC terminal, a lower D+ terminal, a lower D− terminal, a lower power signal terminal and a lower ground terminal. Alternatively, the upper row of conductive terminal 22 comprises an upper ground terminal, an upper power signal terminal, an upper CC terminal, an upper D+ terminal, an upper D− terminal, an upper power signal terminal and an upper ground terminal, and the lower row of conductive terminal 32 comprises a lower ground terminal, a lower power signal terminal, a lower CC terminal, a lower power signal terminal and a lower ground terminal.

When the present invention is used with a USB connector with 14 terminals, the upper row of conductive terminal 22 comprises an upper ground terminal, an upper power signal terminal, an upper CC terminal, an upper D+ terminal, an upper D− terminal, an upper power signal terminal and an upper ground terminal, and the lower row of conductive terminal 32 comprises a lower ground terminal, a lower power signal terminal, a lower CC terminal, a lower D+ terminal, a lower D− terminal, a lower power signal terminal and a lower ground terminal.

When the present invention is used with a USB connector with 16 terminals, the upper row of conductive terminal 22 comprises an upper ground terminal, an upper power signal terminal, an upper RFU terminal, an upper D+ terminal, an upper D− terminal, an upper CC terminal, an upper power signal terminal and an upper ground terminal, and the lower row of conductive terminal 32 comprises a lower ground terminal, a lower power signal terminal, a lower CC terminal, a lower D+ terminal, a lower D− terminal, a lower CC terminal, a lower power signal terminal and a lower ground terminal.

It is further to be noted that, CC terminal, D+ terminal, D− terminal and RFU terminal are defined as follows: CC terminal (Configuration Channel, detection terminal), D+ terminal (Positive half of the USB 2.0 different pair, positive signal terminal), D− terminal (Negative half of the USB 2.0 different pair, negative signal terminal) and RFU terminal (Reserved for future use, reserve terminal).

The present invention has been described with reference to its preferred embodiments. However, it is to be noted that, to one of ordinary skill in the art, amendments and modifications are possible without departing from the principle of the present invention, which amendments and modifications fall within the protection scope of the present invention.

What is claimed is:

1. A Type-C-based USB connector capable of transmitting large current, comprising a housing, an upper insert member and a lower insert member, the upper insert member comprising an upper insulating body and an upper row of conductive terminal, the lower insert member comprising a lower insulating body and integrally formed metallic shielding layer and lower row of conductive terminal, wherein said upper row of conductive terminal comprises at least an upper ground terminal and an upper power signal terminal, and said lower row of conductive terminal comprises at least a lower ground terminal and a lower power signal terminal, characterized in that, each conductive terminal comprises a joint portion at a front end, a soldering portion at a rear end, and a main body provided within the insulating body and positioned between the joint portion and the soldering portion;

the joint portion of the lower ground terminal comprises a ground base and a plate-shaped ground portion protruding downward from the ground base, the ground portion lies in a different plane from that of the ground base, the ground base is provided within the lower insulating body, and the ground portion emerges from the lower insulating body for contacting with the ground terminal of a joint connector;

the joint portion of the lower power signal terminal comprises a power signal base and a plate-shaped signal power portion protruding downward from the power signal base, the power signal portion lies in a different plane from that of the power signal base, the power signal base is provided within the lower insulating body, and the power signal portion emerges from the lower insulating body for contacting with the power signal terminal of a joint connector;

the ground base of the lower ground terminal, the power signal base of the lower power signal terminal, the main body of the lower ground terminal and the main body of the lower power signal terminal are all widened parts.

2. The USB connector as claimed in claim 1, characterized in that, the width of the widened parts is between 0.50 mm to 1.00 mm.

3. The USB connector as claimed in claim 2, characterized in that, the width of the widened parts is between 0.50 mm to 0.80 mm.

4. The USB connector as claimed in claim 1, characterized in that, the connecting position of the metallic shielding layer with the joint portion of the lower ground terminal corresponds to the position of the ground base, and the connecting position of the metallic shielding layer with the joint portion of the lower power signal terminal corresponds to the position of the power signal base.

5. The USB connector as claimed in claim 1, characterized in that, the ground base and the ground portion are formed integrally, and the power signal base and the power signal portion are formed integrally.

6. The USB connector as claimed in claim 1, characterized in that, the joint portion of the lower ground terminal and the main body of the lower ground terminal are formed integrally, and the joint portion of the lower power signal terminal and the main body of the lower power signal terminal are formed integrally.

7. The USB connector as claimed in claim 1, characterized in that, the lower insulating body is provided with an opening corresponding to the ground portion of the lower ground terminal, so that the ground portion of the lower ground terminal emerges from the lower insulating body via this opening, so as to contact with a ground terminal of a joint connector.

8. The USB connector as claimed in claim 1, characterized in that, the lower insulating body is provided with an opening corresponding to the power signal portion of the lower power signal terminal, so that the power signal portion of the lower power signal terminal emerges from the lower insulating body via this opening, so as to contact with a power signal terminal of a joint connector.

9. The USB connector as claimed in claim 1, characterized in that, the soldering portion is a part that extends rearward and beyond the lower insulating body.

10. The USB connector as claimed in claim 1, characterized in that, the front end of the housing has a joint port that is oval shaped, for positive and negative insertions of a joint connector.

11. The USB connector as claimed in claim 5, characterized in that, the joint portion of the lower ground terminal and the main body of the lower ground terminal are formed integrally, and the joint portion of the lower power signal terminal and the main body of the lower power signal terminal are formed integrally.

12. The USB connector as claimed in claim 7, characterized in that, the lower insulating body is provided with an opening corresponding to the power signal portion of the lower power signal terminal, so that the power signal portion of the lower power signal terminal emerges from the lower insulating body via this opening, so as to contact with a power signal terminal of a joint connector.

* * * * *